US007261594B2

(12) United States Patent
Kodama et al.

(10) Patent No.: US 7,261,594 B2
(45) Date of Patent: Aug. 28, 2007

(54) COAXIAL CABLE CONNECTOR AND ELECTRONIC DEVICE CASE

(75) Inventors: Wataru Kodama, Nisshin (JP); Yoshiji Hattori, Nisshin (JP); Takashi Tamezane, Nisshin (JP); Toshihiro Sugiura, Nisshin (JP); Yoshiro Hoshino, Nisshin (JP)

(73) Assignee: Maspro Denkoh Co., Ltd., Nisshin-Shi (JP)

( * ) Notice: Subject to any disclaimer, the term of this patent is extended or adjusted under 35 U.S.C. 154(b) by 44 days.

(21) Appl. No.: 11/413,622

(22) Filed: Apr. 28, 2006

(65) Prior Publication Data

US 2006/0252309 A1 Nov. 9, 2006

(30) Foreign Application Priority Data

Aug. 30, 2005 (JP) ..... 2005-250056
Apr. 20, 2006 (JP) ..... 2006-117086

(51) Int. Cl.
*H01R 9/05* (2006.01)

(52) U.S. Cl. ..... 439/578

(58) Field of Classification Search ..... 439/578–584
See application file for complete search history.

(56) References Cited

U.S. PATENT DOCUMENTS

| | | | | |
|---|---|---|---|---|
| 5,011,432 | A * | 4/1991 | Sucht et al. | 439/584 |
| 6,089,912 | A | 7/2000 | Tallis et al. | |
| 6,776,657 | B1 * | 8/2004 | Hung | 439/578 |
| 6,780,052 | B2 | 8/2004 | Montena et al. | |
| 6,848,939 | B2 * | 2/2005 | Stirling | 439/578 |
| 6,887,103 | B2 * | 5/2005 | Montena et al. | 439/583 |

* cited by examiner

*Primary Examiner*—Ross Gushi
(74) *Attorney, Agent, or Firm*—Burr & Brown

(57) ABSTRACT

A coaxial cable connector having a stopper in a main body for supporting the circumference of the coaxial cable and preventing the coaxial cable from falling out. The stopper is a ring-shaped fastening portion provided in the main body and whose central axis is the same as that of the main body, and a supporting portion which protrudes from the fastening portion in the direction of the central axis of the main body. A rotation-stopping means constituted by a strip-shaped projection is provided on at least an inner surface of the main body to engage the circumference of the coaxial cable. When an end of the coaxial cable is inserted into the main body from behind, the stopper prevents the fall-out of the coaxial cable because the supporting portion supports the circumference of the coaxial cable, and the strip-shaped projection prevents rotation of the coaxial cable.

7 Claims, 16 Drawing Sheets

(a)

(b)

(c)

(a)

(b)

(a)

(b) Cross sectional view taken on the line C-C (a)

(b)

(a)

(b)

(a)

(b)

(a)

(a)

COAXIAL CABLE CONNECTOR AND ELECTRONIC DEVICE CASE

TECHNICAL FIELD

The present invention relates to a connector for connecting the coaxial cables together or for connecting the coaxial cable with a chassis of an electronic device, and a case for an electronic device capable of directly connecting the coaxial cable.

BACKGROUND ART

When attaching a connector to a coaxial cable, hitherto there has been widely adopted a method of crimping a ring portion integrated with ferrule or shell with pliers or a special tool in order to prevent a drop of the cable.

This method is troublesome, however, because the connector has to be attached by being crimped using some tools. Therefore, as described in patent document 1, the structure of a connector is known, in which an inner claw portion is provided in the inner cylindrical portion and an outer claw portion is provided in the outer cylindrical portion so as to lodge a coaxial cable within the connector only by insertion. Moreover, as described in patent document 2 that the present applicant previously filed, the structure of a slip-free connector without necessity of using any crimping tool is provided, in which a ring-shaped stopper having a claw is outwardly attached to a coaxial cable so that the claw can bite into the cable, in order to prevent the slip, and the related structure of a case for an electronic device having the same terminal is provided.

[Patent Document 1]

Japanese Patent publication of unexamined application No. 11-288767

[Patent Document 2]

Japanese Patent publication of unexamined application No. 2002-184536

DISCLOSURE OF INVENTION

Problem to be Solved by the Invention

In the techniques described in Patent document 1, it is possible to obtain a slip-free connector simply by inserting a coaxial cable into the connector. However, with respect to fastening force in the rotative direction of the coaxial cable, it only depends on friction force between a claw and the coaxial cable, so that there is a problem that the coaxial cable rotates easily.

Moreover, in the techniques described Patent document 2, a claw provided with the stopper bites into the coaxial cable in order to prevent the slip without necessity of any crimping, and this fastening force of the claw is also used for fastening force in the rotative direction of the coaxial cable. However, there is a problem that this fastening force is weak with respect to that in the rotative direction of the coaxial cable, because the claw is formed with a thin-plate electrical conducting material having a spring characteristics and the surface which forms the top portion of the claw is oriented to the orthogonal direction with respect to the axis of the coaxial cable so that the coaxial cable can be inserted easily.

Therefore, in consideration for the above problem, the present invention aims to provide a coaxial cable connector and an electronic device case that prevents coaxial cables from falling out as well as rotating and that enables the coaxial cable to be easily attached.

Means for Solving the Problem

In order to solve the above problem, and according to a first aspect of the present invention, a coaxial cable connector is provided including:

a sleeve having an inserting portion to be inserted into between an inner insulator and an outer conductor of the coaxial cable;

a cylindrical main body provided at the periphery of the inserting portion;

a connecting means provided rotatably in front of the sleeve for being connected with the outer conductor of a connecting object, and a fixed ring for fixing the inserting portion of the sleeve after it is inserted into the coaxial cable, wherein a rotation-stopping means is provided on at least an inner surface of the main body, the rotation-stopping means is constituted by a strip-shaped projection which is longitudinally formed so as to bite into the circumference of the inserted coaxial cable, and wherein the strip-shaped projection prevents rotation of the inserted cable.

This structure can prevent the coaxial cable inserted into the connector from falling out by means of the function of the stopper even when a drawing stress is applied. Moreover, this structure can prevent the rotation of the coaxial cable even when rotation stress is applied, resulting that the cable can be assuredly attached in the connector.

According to a second aspect of the present invention, a coaxial cable connector according to the first aspect is provided including:

a sleeve having an inserting portion to be inserted into between an inner insulator and an outer conductor of the coaxial cable;

a cylindrical main body provided at the periphery of the inserting portion;

a connecting means provided rotatably in front of the sleeve for being connected with the outer conductor of a connecting object, and a stopper provided in the main body for supporting the circumference of the coaxial cable in order to prevent the fall-out of the coaxial cable, wherein the stopper is constituted by a ring-shaped fastening portion that is internally provided in the main body so that its central axis is the same as that of the main body, and a supporting portion that is protruded from the fastening portion towards the central axis of the main body, wherein a rotation-stopping means is provided on at least an inner surface of the main body, the rotation-stopping means is constituted by a strip-shaped projection which is longitudinally formed so as to bite into the circumference of the inserted coaxial cable, wherein when an end of the coaxial cable is inserted into the main body of the connector from backward, the stopper prevents the fall-out of the coaxial cable because the supporting portion supports the circumference of the coaxial cable, and the strip-shaped projection prevents rotation of the coaxial cable.

This structure can prevent the coaxial cable inserted into the connector from falling out by means of the function of the stopper even when a drawing stress is applied. Moreover, this structure can prevent the rotation of the coaxial cable even when rotation stress is applied, resulting that the cable can be assuredly attached in the connector. When the end portion of the coaxial cable is formed into a predetermined shape and inserted into the main body of the connector, it is easy to attach the connector since the connector portion is completed after attachment of the connector.

According to a third aspect of the present invention, a coaxial cable connector according to the second aspect is provided, wherein the supporting portion of the stopper is formed such that the distal end thereof makes a line contact with the coaxial cable.

This structure supports the coaxial cable assuredly and improves the locking force.

According to a fourth aspect of the present invention, a coaxial cable connector according to the second or third aspect is provided, further including a releaser for releasing the locking force of the stopper toward the coaxial cable, the releaser having a cylindrical sliding portion for covering the coaxial cable and an operating portion for operating the sliding portion. The distal end of the sliding portion abuts the supporting portion of the stopper and pushes the supporting portion up by sliding the sliding portion forward to release the supporting operation of the coaxial cable.

This structure can release the locking function of the stopper by operating the releaser and allows the cable to be removed easily. Therefore, the cables can be exchanged easily. Further, the inserted coaxial cable can be pulled out only by an easy operation of pushing the releaser, and the releaser is formed in a simple structure.

According to a fifth aspect of the present invention, a coaxial cable connector according to any of the second through fourth aspects is provided, further including a fastening means for fastening the stopper in the main body and prevents the axial movement with respect to the main body and rotation around the axis.

According to this structure, the stopper also serves as a rotation-stopping means and can assuredly prevent the coaxial cable from falling out in combination with said rotation-stopping means.

According to a sixth aspect of the present invention, a coaxial cable connector according to any of the first to fifth aspects is provided, wherein the process for locking the coaxial cable is performed on the entirety or a part of the sleeve.

This structure can provide the coaxial cable which is fixed more assuredly.

According to a seventh aspect of the present invention, a coaxial cable connector according to any of the first to sixth aspects is provided, wherein the process for stopping the rotation of the coaxial cable which is constituted by a strip-shaped projection longitudinally formed is performed on the lateral surface of the sleeve.

This structure can prevent rotation of the coaxial cable more assuredly with a simple structure.

According to an eighth aspect of the present invention, a coaxial cable connector according to any of the first to seventh aspects is provided, wherein the connecting means is a nut that is female-screwed on the inner surface, and a cylindrical fitting portion on which the nut is fit that protrudes in front of the sleeve in order to support the rear portion of the nut in a rotatable way. Moreover, a through hole is provided in the cylindrical fitting portion through which the inner insulator and the central conductor of the inserted coaxial cable penetrate in series with a through hole of the sleeve. The central conductor of the inserted coaxial cable protrudes from the through hole to be arranged on the central axis of the nut.

According to this structure, it is possible to attach a plug terminal to the connector only by forming the end portion of the coaxial cable into a predetermined shape, and hence connect to the receptacle terminal of the electronic device.

According to a ninth aspect of the present invention, a coaxial cable connector according to any of the first to seventh aspects is provided, wherein the connecting means is a male-screwed bolt integrated with the sleeve. A communication hole is formed on the central axis of the bolt, for joining the central conductor of the coaxial cable attached to the main body of the connector with the central conductor of the connecting object, and a fitting metal for joining and supporting the both central conductors is arranged within the communication hole.

According to this structure, it is possible to attach the receptacle terminal only by forming the end portion of the coaxial cable into a predetermined shape, and to easily connect with the plug terminal. Accordingly, both of the coaxial cables can be assuredly connected with each other.

According to a tenth aspect of the present invention, a coaxial cable connector according to any of the first to seventh aspects is provided, wherein the connecting means is formed symmetrically with the sleeve, the two sleeves are opposed to each other and integrated into one body, the main bodies are arranged at the circumference of the both sleeves symmetrically, the stoppers are also arranged within the both main bodies symmetrically, and a fitting metal for joining the both central conductors of the coaxial cables inserted into the both main bodies with each other is arranged in the middle portion.

According to this structure, it is possible to obtain a cable relay connector which directly connects the both cables and joint the both cables easily by only cutting the end portions of the cables into a predetermined shape and inserting the cables in the main body. Further, the cable can be pulled out easily by operating the releaser.

According to an eleventh aspect of the present invention, an electronic device case is provided including a connector for a coaxial cable to be attached from outside, the electronic device case having a sleeve having an inserting portion to be inserted into between an inner insulator and an outer conductor of the coaxial cable, comprising:

a cylindrical main body provided at the periphery of the inserting portion;

connecting means provided rotatably in a front portion of a main body for being connected with the outer conductor of a connecting object, and a fixed ring for fixing the inserting portion of the sleeve after it is inserted into the coaxial cable, wherein a rotation-stopping means is provided on at least an inner surface of the main body, the rotation-stopping means is constituted by a strip-shaped projection which is longitudinally formed so as to bite into the circumference of the inserted coaxial cable, and wherein the strip-shaped projection prevents rotation of the inserted cable.

According to this structure, the coaxial cable provided in the case is prevented from rotating even when a drawing stress is applied, so that it can be mounted assuredly.

According to a twelfth aspect of the present invention, an electronic device case is provided having a connector for a coaxial cable to be attached from outside, the electronic device case having a sleeve having an inserting portion to be inserted into between an inner insulator and an outer conductor of the coaxial cable, comprising:

a cylindrical main body provided at the periphery of the inserting portion;

connecting means provided rotatably in a front portion of a main body for being connected with the outer conductor of a connecting object, and a stopper provided in the main body for supporting the circumference of the coaxial cable in order to prevent the fall-out of the coaxial cable, wherein the stopper is constituted by a ring-shaped fastening portion that is internally provided in the main body so that its central axis is the same as that of the main body, and a supporting portion that is protruded from the fastening portion towards the central axis of the main body, wherein a rotation-stopping means is provided on at least an inner surface of the main body, the rotation-stopping means is constituted by a strip-shaped projection which is longitudinally formed so as to bite into the circumference of the inserted coaxial cable, wherein when an end of the coaxial cable is inserted into the main body of the connector from the back, the stopper prevents the coaxial cable from falling out because the supporting portion supports the circumference of the coaxial cable, and the strip-shaped projection prevents rotation of the coaxial cable.

This structure can prevent the coaxial cable inserted into the connector from falling out by means of the function of the stopper even when a drawing stress is applied. Moreover, this structure can prevent the rotation of the coaxial cable even when rotation stress is applied, resulting that the cable can be assuredly attached in the connector. When the end portion of the coaxial cable is formed into a predetermined shape and inserted into the main body of the connector, it is easy to directly attach the coaxial cable to the case. Accordingly, it is unnecessary to attach the connector to the coaxial cable separately.

According to a thirteenth aspect of the present invention, an electronic device case is provided according to the fifteenth aspect, wherein the supporting portion of the stopper is formed such that the distal end thereof makes a line contact with the coaxial cable.

This structure supports the coaxial cable assuredly and improves the locking force.

According to a fourteenth aspect of the present invention, an electronic device case is provided according to any of the twelfth or thirteenth aspect, wherein a releaser for releasing the locking force of the stopper toward the coaxial cable is provided, the releaser including a cylindrical sliding portion for covering the coaxial cable and an operating portion for operating the sliding portion. The distal end of the sliding portion abuts the supporting portion of the stopper and pushes the supporting portion up by sliding the sliding portion forward to release the supporting operation of the coaxial cable.

This structure can release the locking function of the stopper by operating the releaser and allows the cable to be removed easily. Therefore, the cables can be exchanged with ease. Further, the inserted coaxial cable can be pulled out only by an easy operation of pushing the releaser, and the releaser is formed in a simple structure.

According to a fifteenth aspect of the present invention, an electronic device case is provided according to any of the twelfth to fourteenth aspects, wherein a fastening means is provided for fastening the stopper in the main body and preventing the axial movement with respect to the main body and rotation around the axis.

According to this structure, the stopper also serves as a rotation-stopping means and can prevent the fall-out of the coaxial cable assuredly in combination with said rotation-stopping means.

The invention according to a sixteenth aspect of the present invention, an electronic device case is provided according to any of the eleventh to fifteenth aspects, wherein the process for locking the coaxial cable is performed on the entirety or a part of the sleeve.

This structure can provide the coaxial cable which is fixed more assuredly.

The invention according to a seventeenth aspect of the present invention, an electronic device case is provided according to any of the eleventh to sixteenth aspects, wherein the processing for stopping the rotation of the coaxial cable which is constituted by a strip-shaped projection longitudinally formed is performed on the lateral surface of the sleeve.

This structure can prevent fall-out of the coaxial cable more assuredly with a simple structure.

EFFECTS OF THE INVENTION

As mentioned above, according to the coaxial cable connector of the invention, the coaxial cable inserted into the connector can be prevented from falling out even when a drawing stress is applied due to the function of the stopper. Moreover, due to the function of the rotation-stopping means, the rotation of the coaxial cable is prevented even when rotation stress is applied. As a result, the cable can be assuredly attached. On the other hand, the blocking function of the stopper can be released by providing the releaser and the cable can be pulled out easily. Therefore, the cables can be exchanged easily.

Further, by attaching the stopper so as to serve as a rotation-stopping means, rotation of the cable is further prevented.

The coaxial cable, in an attached state, is prevented from rotation even in the pull-out capable structure, kept in a good connection with the connector. The attachment of the connector is completed only by forming the end portion of the coaxial cable into a predetermined shape and inserting it into the main body of the connector, which is an easy operation.

According to the electronic device case of the invention, the coaxial cable attached within the case can be prevented from dropping out even when a drawing stress is applied due to the function of the stopper. Moreover, due to the function of the rotation-stopping means, the rotation of the coaxial cable is prevented even when rotation stress is applied, resulting that the cable can be assuredly attached. On the other hand, since the blocking function of the stopper can be released by operating the releaser, the cables can be exchanged at ease. The attachment of the connector to the case is completed only by forming the end portion into a predetermined shape and inserting it into the main body of the connector and the attachment of the coaxial cable is easy.

EMBODIMENTS OF THE INVENTION

Hereinafter, embodiments of the present invention will be described in detail according to the drawings. FIG. 1 shows the first embodiment of a coaxial cable connector (hereafter, referred to simply as a connector) related to the invention, and it is an explanatory view showing an important portion of the connector mounted in the coaxial cable, with a partly-enlarged view.

In FIG. 1, the reference numeral 1 indicates a main body of the cylindrical connector, including cable-attaching means, for covering a coaxial cable (hereafter, referred to simply as a cable) and the reference numeral 2 indicates a connecting means for connecting the cable to a connecting object such as a receptacle, which is a nut in this embodiment. The cable-attaching means includes a stopper 3 for preventing the inserted cable from falling out, an anchor 4 for fixing the stopper 3, a releaser 5 for releasing the lock function of the stopper 3, and a sleeve 61 having an inserting portion 6 to be inserted between an inner insulator 7*b* and an outer conductor 7*c* of the cable 7 to be attached, and the description will be made with the left-hand side defined as the front in this figure. The reference numeral 7*a* indicates a central conductor and the reference numeral 7*d* indicates a protective covering of the cable.

The main body of the connector 1 has an attaching portion 1*a* at the front side for attaching the protective covering of the coaxial cable inserted into the sleeve 61, and a cylindrical portion 1*b* extendedly provided from the outer circumference of the attaching portion towards backward. A fitting hole for mounting the sleeve 61 is defined at the attaching portion. Moreover, an opening defined at the rear of the cylindrical portion 1*b* is a cable inserting hole which is formed in communication with the fitting hole.

Moreover, from the inner surface of the connector main body 1 towards the central axis, a plurality of linear strip-shaped projections 45 which serve as a rotation-stopping means are formed from the front side of a space for housing the coaxial cable towards backward. The cross-sections of the strip-shaped projections are rectangular or triangle shape, and in this embodiment they are tapered from the cable inserting side to the distal end.

As shown in FIG. 2(*a*), the sleeve 61 includes an inserting portion 6 integrally formed at the back of a ring-shaped joining portion 10 for connecting the sleeve 61 with the fitting hole defined at the front side end of the connector main body 1. The inserting portion 61 is formed in a conically-shape, having a wall thickness tapering down backwardly from the joining portion. This shape makes it easy for a sleeve 61 to penetrate between the inner insulator 7*b* and the outer conductor 7*c* of the cable 7.

The cylindrical fitting portion 8 protrudes with a small diameter at the front of the ring-shaped joining portion 10. A nut 2 as a connecting means is connected with the cylindrical fitting portion 8. In this embodiment, the nut 2 includes a female screw on its inner surface and a joint hole 2*a* where the cylindrical fitting portion 8 of the sleeve 61 is inserted at the rear portion. As a result, the nut 2 can be attached to the front of the sleeve 61 in a rotatable way. The distal end portion 8*b* of the cylindrical fitting portion 8 expands in diameter after joining with the nut 2, thereby preventing the nut 2 from falling out.

Moreover, at the inserting portion 6 and the cylindrical fitting portion 8, a through holes 6*a*, 8*a* through which the inner insulator 7*b* and the central conductor 7*a* of the cable 7 penetrate are defined having a same diameter.

As shown in FIG. 2(*b*), at the lateral side of the inserting portion 6 of the sleeve 61, process of rotation-stopping of the inserted coaxial cable may be provided, represented by a plurality of linear strip-shaped projections 111. The strip-shaped projections 111 are tapered to the end, similarly to the inserting portion 6 of the sleeve 61.

Only one strip-shaped projection 111 may be provided, or it may be formed one portion of the side surface rather than on the whole side surface from the base of the inserting portion 6 of the sleeve 61 backward toward its rear end.

Moreover, instead of the strip-shaped projection 111, as shown in FIG. 2(*c*), the configuration with the processing for the blocking function of the inserted coaxial cable may be formed, represented by a mesh-shaped groove, what is called, a knurl 35 to be provided at the circumference of the inserting portion 6. Especially, in case of the knurl 35, it is effective in preventing the rotation of the coaxial cable and removing the oxide film attached to the outer conductor 7*c* of the coaxial cable, with more assured electrical connection. This processing for blocking can be applied to the inserting portion 6 of the sleeve 61 of the other embodiments.

As illustrated in the front view of FIG. 3(*a*), the stopper 3 is substantially formed into disc and made of elastic metal, for example, stainless metal for spring.

This stopper 3 includes a ring-shaped fastening portion 3*b* whose central axis is the same as that of the connector main body 1, and a plurality of claws 3*a* provided with the fastening portion 3*b* so as to protrude in the direction of the central axis of the fastening portion 3*b*.

Although the distal end of the claw 3*a* is formed in a trapezoidal shape in the present embodiment, the distal end may be acuminated to allow the cable to be easily inserted. Moreover, the inner diameter formed by the claw 3*a* may be formed in a smaller size than the outer diameter of the cable 7 to be inserted in order to strengthen bearing force against the force in the removing direction of the cable. Moreover, the inner peripheral portion of the stopper 3 is provided with radius in accordance with the diameter of the cable so that the distal end of the claw 3*a* may make line contact with the cable 7. In this way, the shape of the claw 3*a* is not particularly limited and any shape is acceptable as long as it has a configuration which is suitable to a predetermined fastening force required to maintain the cable.

As illustrated in the section view taken along the line B-B in FIG. 3(*b*), the supporting portion 3*a* is bent toward the inner direction of the connector main body 1 at about 45° of the bent angle θ, and the whole stopper 3 is formed in substantially conical shape with the front portion narrower.

By bending as the above, the supporting portion 3*a* expands easily in diameter at a time of inserting operation of the cable, thereby smoothing the inserting operation. When a drawing stress is applied to the inserted cable, the supporting portion assuredly bites into the cable, thereby preventing the cable from dropping out.

Further, the fastening portion 3*b* of the stopper 3 has a predetermined flat surface in the outer peripheral direction, and in the connector main body 1 in which the flat surface 3*b* is disposed, a stepped portion 14*a* of a fixed sleeve 14 and an end portion of the fixed ring 15 hinder the back-and-forth movement of the fastening portion 3*b*. Because of this, the fastening portion 3*b* is not deformed being bent forward or backward even if a large stress is applied to the cable, the bent angle θ of the claw 3*a* of the stopper 3 is maintained with a favorable supporting operation.

In addition, when a fastening portion 3*b* is bound with a stepped portion 14*a* of a fixed sleeve 14 and an end portion of the fixed ring 15, the fixed sleeve 14 and the fixed ring 15 are attached so as to closely contact with each other. This configuration prevents the stopper from not only moving back and forth but also rotating. This means that the stopper 3 also serves as a rotation-stopping means, resulting that the cable can be attached reliably because it withstands a drawing stress applied to the cable as well as a rotation stress applied thereto.

In this embodiment in which the stopper 3 serves as a rotation-stopping means, the fixing sleeve, the fixing ring, and the flat surface 3*b* of the stopper 3 are a fixing means claimed in the present invention.

When manufacturing the stopper, the claw 3*a* is made by punching out and then, the claw 3*a* is bent. Favorably, the claw 3*a* is cut-out, starting from the front (the left side in FIG. 3(*b*)). Thus, the rear end portion of the claw 3*a* (the inner peripheral end portion at the left side in FIG. 3(*b*)) coming into contact with the cable 7 is formed into an acute angle, thereby enabling the assured support of the cable 7. In FIG. 3, although six claws are provided, it is possible to change the number easily by changing the width of the cut-out portion. Namely, it is possible to change the number of the claws 3*a*.

The stopper 3 thus formed is fixed to the anchor 4 and then arranged in the connector main body 1. The anchor 4 consists of the fixed sleeve 14 for fastening it to the connector main body 1 and the fixed ring 15 for fastening the stopper 3 to the fixed sleeve 14 and the fixed sleeve 14 has the stepped portion 14*a* for blocking the stopper 3 inwardly and the releaser inserting portion 14*b*. The fixed ring 15 is formed with the same diameter as the stopper 3. The stopper 3 is fixed to the anchor 4 by inserting the stopper 3 from the front side to a fixed position of the fixed sleeve 14 as well as by inserting the fixed ring 15, and the diameter of the end opening portion of the fixed sleeve 14 is shrunken by press. Thus, the fixed ring 15 is prevented from falling out and the stopper 3 can be fixed within the anchor 4.

By pressing the anchor 4 with the stopper 3 fixed therein from the rear portion of the connector main body 1, the stopper 3 is built into the connector main body 1.

The releaser 5 is formed by a cylindrical sliding portion 5*a* sliding around the cable 7 and a brim-shaped operating portion 5*b*, provided in the back of the sliding portion 5*a*, for operating the sliding portion 5*a*. The sliding portion 5*a* has a length extending from the rear portion of the fixed sleeve 14 to the stopper 3, and its distal end is formed into an acute angle with a tapering surface providing a fitting portion 5*d* abutting the supporting portion 3*a* of the stopper 3 as illustrated in the enlarged view of portion A shown in FIG. 1. The outer periphery of the sliding portion 5*a* has a stepped portion 5*c* that is engaged with a projection 14*c* formed on the releaser inserting portion 14*b* of the fixed sleeve 14 so that the projection 14*c* can prevent the inserted releaser 5 from falling out.

The operating portion 5*b* is positioned in the back of the connector main body 1 and by pressing the operating portion 5*b* forward such that the sliding portion 5*a* slides and the end operating portion 5*d* presses the claw 3*a* forward. As a result, the claw 3*a* expands in diameter and the supporting portion 3*a* is floated up from the cable 7. Thus, the cable 7-supporting function of the stopper 3 is released and the blocking function is released.

Next, the procedure of assembling the connector and attaching the connector to the cable will be described. At first, a ring-shaped joining portion 10 formed in the sleeve 61 is inserted into the fitting hole of the connector main body 1 from behind. At this time, the ring-shaped joining portion 10 is integrated with the connector by press or the like. After fitting the nut 2 into the cylindrical fitting portion 8, the distal end 8*b* is expanded in diameter to join the nut 2 with the connector main body 1 in a rotatable way.

Then, as described above, the stopper 3 fixedly supported by the fixed sleeve 14, and the fixed ring 15 is inserted into the connector main body 1 and the stopper 3 is inserted, hence to complete the connector.

The operation of attaching the cable 7 will be executed as follows. The end portion of the cable 7 to be inserted is at first processed. More specifically, as illustrated in FIG. 1 (or FIG. 4 described later), the inner insulator 7*b* and the protective covering 7*d* are cut-out so as to bare the central conductor 7*a* and the inner insulator 7*b* in a predetermined length, and the outer conductor 7*c* is rolled up on the protective covering 7*d*. Then, the cable 7 may be inserted into the connector main body 1 from backward.

FIG. 4 shows the state before inserting the cable into the connector, FIG. 5 is an explanatory side view showing the state on the way of inserting the cable, and the state after inserting the cable is as shown in FIG. 1. The cable 7 is inserted into the connector main body 1 up to a predetermined position where the protective covering 7*d* abuts on the attaching portion provided in the connector main body 1. Thus, the inserting portion 6 penetrates between the inner insulator 7*b* and the outer conductor 7*c* and provides a sure electrical contact between the outer conductor 7*c* and the connector main body 1 through the sleeve 61. The strip-shaped projections 45 formed in an inner surface of the connector main body 1 hinder the easy rotation of the cable 7, even if rotation stress is applied, which maintains a favorable connection state. Moreover, by providing the strip-shaped projections 111 or the knurl 35 at the circumference of the inserting portion 6 of the sleeve 61, the cable can stand the rotation stress more.

The claw 3*a* assuredly supports the cable 7 as mentioned above. Further, the distal end of the central conductor 7*a* protrudes to the end of the nut 2, and the central conductor of the cable 7 is positioned at the central axis (M) of the nut 2, hence to obtain the central conductor of the connecting means.

In FIG. 4 and FIG. 5, the reference numeral 7*e* indicates aluminum foil. The outer conductor of the coaxial cable is generally formed by the mesh conductor (the above mentioned outer conductor 7*c*) and the aluminum foil 7*e* provided therein. When having the aluminum foil 7*e* as mentioned above, upon processing the end portion of the cable, the aluminum foil 7*e* is attached to the inner insulator 7*b* without being rolled up and the sleeve 6 comes through between the aluminum foil 7*e* and the mesh conductor (the above mentioned outer conductor 7*c*).

As mentioned above, the coaxial cable inserted into the connector is prevented or blocked from falling out by a stable attachment, even if the drawing stress is applied to the connector, because of the function of the stopper. On the other hand, the operation of the releaser can release the blocking function of the stopper so that the cable can be easily pulled out or disconnected from the connector. When the end of the coaxial cable is processed into a predetermined shape and then inserted into the connector main body 1, the connector portion will be completed after attachment of the connector, so that attachment of the connector becomes easy. Moreover, the removed connector can be recycled usefully.

Moreover, the strip-shaped projection 45 provided in an inner surface of the connector main body 1 prevents the rotation of the coaxial cable, so that a good connection state can be maintained. Moreover, a coaxial cable connector can stand the rotation of the cable more securely by combining the strip-shaped projection 45 with the fixing means for fixing the stopper 3, the strip-shaped projection 111 provided at the circumference of the inserting portion 6, or the knurl 35.

Further, since the releaser has the simple structure and form, the structure of the connector is not complicated, and since the connecting means can be realized by a plug, it can be connected to a receptacle terminal of an electronic device and the like. It should be noted that although a releaser is provided in this embodiment, the releaser may be omitted.

A second embodiment of the connector according to the present invention will be described with reference to FIG. 6. FIG. 6 is a side lateral view showing an important portion in cross section. The second embodiment is different from that of FIG. 1 in that the connecting means is a receptacle including a male-screwed bolt 20. The same reference numeral is attached to the same components as those of FIG. 1, and further description of the same is omitted.

The bolt 20 is integrally formed at the front of the ring-shaped joining portion 10. The bolt 20, the ring-shaped joining portion 10, and the inserting portion 6 constitute the sleeve 62. The reference numeral 21 denotes a main body of the connector in the second embodiment.

The bolt 20 includes a communicating hole 22 which communicates with the through hole 6*a* of the sleeve 6 within the connector main body 21, where the central conductor (not illustrated) of the connecting object is inserted on the central axis M. Within the connecting hole 22, a fitting metal 23 is provided for joining the central conductor 7*a* of the cable 7 inserted into the connector main body 21, with the central conductor (not illustrated) of the connector of the connecting object. The fitting metal 23 is arranged within a cylindrical supporter 24 made of resin and the cylindrical supporter 24 has apertures 24*a* through which the central conductor penetrates on the front and back surfaces thereof respectively.

This connector is assembled at first by inserting and pressing the ring-shaped joining portion 10. Next, a cylindrical supporter 24 with the fitting metal 23 built-in is inserted into the bolt 20 from the front of the bolt 20. The cylindrical supporter 24 is prevented from fall-out by contracting the diameter of the distal end of the bolt 20 for example. Alternatively, an adhesive agent may be used for fixing. Similarly to the first embodiment, the releaser 5 and the stopper 3 supported by the fixed sleeve 14 and the fixed ring 15 are assembled.

The procedure of attaching the cable 7 is the same as that in the first embodiment. The cable 7 whose end is processed into a predetermined shape is inserted into the connector main body 21 and assuredly attached thereto and it will not fall out even if a drawing stress is applied. Moreover, the strip-shaped projection 45 formed in an inner surface of the connector main body 21 prevents rotation of the cable even if rotation stress is applied. The central conductor 7*a* of the inserted cable 7 is inserted into the cylindrical supporter 24 and clamped by the fitting metal 23.

Thus, by forming the connecting means as a receptacle, a plug as mentioned in the first embodiment can be connected, and both of the connected central conductors are jointed by the fitting metal 23, and both of the outer conductors are jointed through the bolt 20, thereby establishing a good connection of the cables. Similarly to the first embodiment, it is possible to assuredly attach the cable to the connector and o easily pull out or release the cable therefrom by operating the releaser.

FIG. 7 shows another form of the connector according to the invention. Of the components of FIG. 6, the bolt as the connecting means is formed in the same shape as that of the main body of the connector 21 and a cable can be directly attached there. The same reference numeral is attached to the same component as that of FIG. 6 and the description thereof is omitted.

As illustrated in FIG. 7, a connector cylinder 25 with the main bodies of the connector 21 opposed at the both sides is disposed in the central portion, and a fitting metal 23 for joining the both central conductors 7*a* and 7*a* is arranged in the connector cylinder 25. The main bodies of the connector 21 are assembled at the ring-shaped joining portions 10 disposed symmetrically at the both sides of the connector cylinder 25. The above-mentioned sleeve 6, stopper 3, and releaser 5 are assembled symmetrically within the main body of the connector 21.

Because of the above structure, a cable relay connector can connect both cables directly and an easy connection can be obtained only by cutting off the end of the cable into a predetermined shape and inserting it into the connector. Further, the cable can be pulled out easily by operating the releaser. It should be noted that the releaser may be omitted.

FIGS. 8 and 9 show a cross sectional view of a connector according to a third embodiment of the present invention. FIG. 8(*a*) shows a state in which a coaxial cable is inserted, and FIG. 8(*b*) is a cross-sectional view taken along the line C-C of FIG. 8(*a*). FIG. 9 shows a state in which a coaxial cable is not inserted. The third embodiment is quite different from the above embodiments about attachment structure of the stopper 3 and the releaser 5 are simplified. The elements which are the same as that in FIG. 1 are denoted the same reference numbers and explanation thereof will be omitted. In FIGS. 8 and 9, the reference number 41 denotes a main body of the connector.

According to this embodiment, the ring-shaped joining portion 10 to be connected to the connector main body 41 is provided, and the sleeve 61 protrudes from the rear portion of the ring-shaped joining portion 10, whereas a cylindrical fitting portion 8 protrudes from the front portion of the ring-shaped joining portion 10. The sleeve 61 has a wall thickness tapering down backwardly and the through hole 6*a* is provided in an inner portion integrally formed in a conically-shape. The cylindrical fitting portion 8 has a small diameter in which the nut 2 is fit. The ring-shaped joining portion 10 is inserted and fixed in the connector main body 41 from the front. The cylindrical fitting portion 8 has a through hole which the inner insulator 7*b* and the central conductor 7*a* of the inserted cable 7 penetrate through. The through hole has the same diameter as that of a through hole 6*a* formed in a sleeve 6. The nut 2 includes a female screw on its inner surface and a joint hole 2*a* where the cylindrical fitting portion 8 of the main body 1 is inserted at the rear portion. As a result, the nut 2 can be attached at the cylindrical fitting portion 8 in a rotatable way. The distal end portion 8*b* of the cylindrical fitting portion 8 expands in diameter after joining with the nut 2, thereby preventing the nut 2 from falling out.

The connector main body 41 has a fitting hole 42 into which the ring-shaped joining portion 10 is inserted and fixed at the front side, and a cable inserting hole 43 at the rear side.

The cable inserting hole 43 has a stepped portion 43*a* in the interior of the opening portion. The circumference of the stepped portion 43*a* is configured so that the fastening portion 3*b* of the stopper 3 is inwardly abutted. After the fastening portion 3*b* of the stopper 3 is disposed so as to abut on the stepped portion 43*a*, the cable is attached to a distal portion 43*b* whose diameter is reduced by spinning or curling.

As a mounting method of the stopper, it may be acceptable that after disposing the stopper on the stepped portion 43*a* a cover is disposed on the connector main body 41 so as to cover the stepped portion 43*a* by, for example, press fitting.

In this third embodiment, the stopper is prevented from moving as well as rotating in the axial direction when the distal portion of the cable inserting hole whose diameter is reduced by spinning or curling or the cover press-fitted into the cable inserting hole is assuredly fixed on the fastening portion 3*b*. As a result, the stopper 3 also serves as a rotation-stopping means. Consequently, the fastening means in this third embodiment is a flat surface of the fastening portion 3*b*, the stepped portion 43*a* and the distal end portion of the cable inserting hole (or a cover).

Further, a plurality of linear strip-shaped projections 45 are provided in the direction of the central axis from the interior of the connector main body 41, starting from the front of a housing for the coaxial cable formed within the connector main body 41, as the rotation-stopper means. These strip-shaped projections 45 have a cross section in a rectangular or triangle shape and in this embodiment they are tapered from the front side.

As described above, since the strip-shaped projections 45 are provided in the interior of the connector main body 41, by inserting the coaxial cable, when the inserting portion 6 goes through between the inner insulator and the outer conductor and the protective covering is rolled up around the inserting portion, the strip-shaped projections 45 are assuredly bite into the protective covering. FIG. 8(*b*) is a cross-sectional view taken along the line C-C of FIG. 8(*a*), showing this biting state.

In other words, in this embodiment when the protective covering of the coaxial cable is attached, the protective covering is fastened by the fastening portion 3*a* of the stopper 3 and the distal end of the coaxial cable is sandwiched between the inserting portion 6 from inward, and the strip-shaped projection 45 from outward. Whereby, the excellent gripping force is applied and the coaxial cable is prevented from rotating assuredly. In addition, by fastening the stopper 3 with a fastening means, the coaxial cable can be mounted more rigidly against rotating force. Moreover, since members such as the latch 17 and the releaser 5 are unnecessary in this embodiment, the cost for material or assembly can be reduced. This makes it possible to reduce manufacture cost and thereby providing a suitable structure for a coaxial cable which requires a reasonable cost.

In addition, although the main bodies of the connectors 1, 21, 41 and the connector cylinder 25 are formed in a cylindrical shape in the above-mentioned embodiments, they may be formed into the other shape, for example, a hexagonal tube. The connecting means may be formed in any other structure than the structure of the above plug and the above receptacle.

FIGS. 10 and 14 show cross sectional views of a connector of the present invention according to a fourth embodiment. FIG. 10 shows a state in which a coaxial cable is inserted, and FIG. 11 shows a state before insertion of a coaxial cable. The fourth embodiment is different from the third embodiment about attachment structure of the stopper 3 with respect to the connector main body 41 and the structure of the stopper 130 as shown in FIG. 12. FIG. 12(*a*) is a front view and FIG. 12(*b*) is a cross sectional view taken along the line D-D. A cable inserting portion corresponding to the stopper 130 is 143 shown in FIG. 14(*a*). The elements which are the same as that in FIGS. 10-14 are denoted the same reference numbers and explanation thereof will be omitted.

As well illustrated in FIG. 12, the stopper 130 in this fourth embodiment has a fastening claw denoted as 130*c* on the fastening portion 130*b* which corresponds to the fastening portion 3*b* of the stopper 3. One or a plurality of the fastening claw(s) 130*c* is/are disposed and folded at the periphery of the fastening portion 130*b* so as to protrude toward the front of the connector.

As shown in FIG. 14(*a*) corresponding to this stopper 130, a fitting portion into which the fastening portion 130*c* is fitted is provided at the cable inserting portion 143 formed at the rear of the connector main body 41.

This cable inserting portion 143 has a stepped portion 143*a* in the interior of the opening portion similarly to the above embodiments. The periphery of the stepped portion 143*a* is configured so that the fastening portion 130*b* is internally abutted. In addition, when the fastening portion 130*b* of the stopper 130 is disposed so as to abut on the stepped portion 143*a*, the fitting groove 143*c* into which the fitting claw 130*c* provided with the fitting portion 130*b* is inserted is formed in a position opposite to the fitting claw 130*c*. Further, a male screw 143*b* is formed on the outer periphery of the rear lateral end portion of the connector main body 41.

The reference number 153 denotes a cap provided attachably and detachably on the lateral end portion of the connector main body 41. The cap 153 has a through hole 152 at the center, into which the coaxial cable is inserted. In the interior of the cap 153, a female screw 153*b* is formed so as to be threadedly engaged with the male screw formed on the lateral end portion of the connector main body. This cap has the same effect as the anchor 4 and spinning or curling in which the diameter of the distal end portion of the cable inserting hole is reduced. Whereby, the stopper 130 for the connector can be attached into the connector main body. It should be noted that the fitting claw 130*c* and the fitting groove 143*c* are a fastening means claimed in the present invention.

In other words, according to this embodiment, upon attachment of the protective covering of the coaxial cable the protective covering is fastened by the claw 130*a* of the stopper 130 at the rear end of connector main body 41. Thus, the coaxial cable is prevented from falling out in the axial direction and rotation around the axis.

Further, since the distal end of the coaxial cable is sandwiched between the inserting portion 6 from an inner side and the strip-shaped projection 45 from an outer side, a more excellent gripping force is applied and rotation of the coaxial cable is prevented assuredly.

Further, in this embodiment a fixing cap 153 for the stopper 130 is provided attachably and detachably. Thus, when the connector is shipped, a user can attach the cable easily and quickly by inserting the coaxial cable as long as the cap 153 is threadedly mounted into the cable inserting hole 143. In such a case, even if there is a mistake in inserting the cable, the user can remove the cap 153 by using an ordinary tool and the stopper 130 can be removed from the connector main body 41 easily. As a result, re-attaching of the coaxial cable is achieved with ease. In addition, considering the long period of use, the structure can readily deal with the restructuring of the coaxial cable 7 such as system change.

FIGS. 13(*a*) and 13(*b*) show another example of the stopper 130. FIG. 13(*a*) is a front view and FIG. 13(*b*) is a cross sectional view taken along the line E-E. In this embodiment, cut-out portions 130*d* are formed on the fastening portion 130*b* instead of the fastening claw 130*c*. In the interior of the cable inserting portion 143, as shown in FIG. 14(*b*), projections 143*d* which extends from the stepped portion 143*a* to fit into the cut-out portion 130*d* is provided. Similarly to the fourth embodiment, the coaxial cable is attached so that rotation of the stopper 130 is prevented by engagement between the cut-out portions 130*d* and the projections 143*d*.

It should be noted that a method for attaching the stopper in the fourth embodiment is not limited to this embodiment. Needless to say, this method can be applied to other embodiments.

Moreover, in the fourth embodiment a fastening means for blocking rotation of the stopper 130 is shown. However, the fastening means is not particularly needed and not limited to this embodiment as long as the stopper is attachably and detachably mounted.

FIG. 15 is a cross-sectional view showing a fifth embodiment of the connector of the present invention. FIG. 15 shows a state in which a coaxial cable is inserted. The fifth embodiment is quite different from the above embodiments in that the stopper and the releaser 5 are simplified, and a crimping ring 37 is provided instead of the stopper for the cable. The elements which are the same as that in FIG. 1 are denoted the same reference numbers and explanation thereof will be omitted. In FIG. 15, the reference number 51 is a main body of the connector.

The main body of the connector 51 has a fitting hole 42 for inserting and pressing the ring-shaped joining portion 10 at the front. The anteroposterior length (that is, the length of the cylindrical portion 1*b*) is shorter than that of the above embodiments by the length of the stopper and releaser which are not necessary. From the inner surface of the connector main body 51 towards the central axis, a plurality of linear strip-shaped projections 45 which serve as a rotation-stopping means are formed from the front side of a space for housing the coaxial cable towards backward. The cross-sections of the strip-shaped projections are rectangular or triangle shape, and in this embodiment they are tapered from the cable inserting side to the distal end.

The sleeve 61 includes an inserting portion 6 integrally formed at the back of a ring-shaped joining portion 10 to be connected with the fitting hole 42. The inserting portion 6 is formed in a conically-shape, having a wall thickness tapering down backwardly from the joining portion. At the rear end of the inserting portion 6, a ring-shaped projection 36 is provided in the outer circumference direction. Moreover, at the front of the ring-shaped joining portion 10, a cylindrical fitting portion 8 with a small diameter protrudes. A connecting means 2 is connected with this cylindrical fitting portion 8 as described above.

In this embodiment, the rear end of the inserting portion 6 is positioned posterior to the cylindrical portion 1*b* penetrating through the cylindrical portion 1*b* of the connector main body 51.

In assembling procedure of the coaxial cable, upon connecting the cable 7 with the inserting portion 6, the crimping ring 37 is disposed at a position to fixing the inserting portion 6. Then, the crimping ring 37 is crimped from outside of the outer surface of the cable.

According to the fifth embodiment as configured above, the coaxial cable is prevented from the fall-out, with stable attachment, even if the drawing stress is applied to the connector, because of the crimping ring 37 as a crimping means and a ring-shaped projection 36 as a stopper provided at the rear end of the inserting portion 6.

Moreover, the strip-shaped projection 45 provided in an inner surface of the connector main body 51 prevents the rotation of the coaxial cable, so that a good connection state can be maintained. Moreover, a coaxial cable connector can stand the rotation of the cable more securely by providing the strip-shaped projection 111 at the circumference of the inserting portion 6 and providing the knurl 35, and by combining them with the strip-shaped projection 45.

In addition, a simple structure is feasible since the stopper and releaser and so on are unnecessary, so that costs can be moderate.

FIG. 16 shows one example of an electronic device case (hereinafter, referred to simply as a case) according to the present invention. FIG. 16 is an explanatory view of a cross section, the reference numeral 27 indicates a case, the reference numeral 28 indicates a circuit board arranged within the case, and the reference numeral 29 indicates a connector for inserting the coaxial cable therein. In this embodiment, the sleeve is constituted by the ring-shaped joining portion 10 and the inserting portion 6, and denoted as 63 in FIG. 16. The inserting portion 6 is integrally formed at the back of the ring-shaped joining portion 10 and formed in a conically-shape, having a wall thickness tapering down backwardly. The same reference numerals are attached to the same components as that of FIG. 1 and repeat descriptions thereof are omitted.

The case 27 is formed by a main body 27*a* and a cover plate 27*b*, they are made of metal, and the inside is shielded from electromagnetic force. A connector 29 for connecting the cable is formed on the side surface of the main body 27*a*. The connector 29 is formed by protruding the cylindrical main body of the connector 30 integrally formed with the case 27 and providing the same cable-attaching means as that of FIG. 1 therein.

On the other hand, the wall surface of the main body 27*a* corresponding to the distal end of the connector 29 includes a communicating hole 31 for introducing the central conductor 7*a* and the inner insulator 7*b* of the connected coaxial cable 7 into the inside of the case 27, and the central conductor 7*a* of the cable 7 inserted into the main body of the connector 30 extends into the inside. A fitting metal 32 for joining the central conductor 7*a* is arranged on the circuit board 28 disposed within the case 27 in accordance with the position of the central conductor 7*a* on the central axis M of the inserted cable 7, and the connecting means is formed on this circuit board 28.

Thus, by providing the same coaxial cable-attaching means as the connector in the case, the inserted cable can be assuredly attached according to the function of the stopper 3, will not fall out even if a drawing stress is applied. By operating the releaser, the locking function according to the stopper can be released and the cable can be released or pulled out easily, thereby making the work of exchanging cables easy. Further, since the cable can be attached to the case merely by processing the end of the cable into a predetermined shape and inserting it into the main body of the connector, there is no need to separately attach a connector to the cable, and a connection can be established with a simple structure.

Since the strip-shaped projections 45 provided in an inner surface of the connector main body 41 is configured to block the movement of the coaxial cable in the rotative direction, a favorable connection state can be maintained.

Further, since the releaser has a simple structure and shape, the structure of the cable-attaching means also becomes simple.

Although the main body of the connector 30 protrudes outwardly protruded from the case 27 in this embodiment of the case for the electronic device, it may inwardly protrude within the case 27 in the counter direction and then, the coaxial cable-attaching means may be formed within the case. Although the inside space becomes narrower, the bare portion of the cable connecting portion can be shortened, the connecting portion can be more stable, and the appearance is improved. Although the connecting means is attached on the circuit board, the fitting metal 32 may be attached on the side of the main body of the connector 30.

In addition, for the electronic device case which aims to reducing cost, the structure in the third embodiment as shown in FIGS. 8 and 9 in which a connector with a structure where the strip-shaped projection 45 is provided in the interior of the connector main body and the stopper 3 is fixed by curling and so on is suitable.

Further, the structure in the fourth embodiment as shown in FIGS. 10 and 11, that is, a connector with a structure where the strip-shaped projection 45 is provided in the interior of the connector main body and the stopper 130 is provided with the connector main body attachably and detachably, is suitable for the electronic device case which becomes more convenient, because not only the coaxial cable can be inserted but also the coaxial cable can be removed in case of attachment error or change of wiring system.

In addition, for the electronic device case which aims to have a simple structure and reduce cost, the structure in the fifth embodiment as shown in FIG. 15 in which a connector with a structure where the strip-shaped projection 45 is provided in the interior of the connector main body and the cable is crimped by the crimping ring 37 is suitable.

Although a releaser is provided in every embodiment in order to have a release function, when it is used in a portion requiring no release function, it is not necessary to provide the releaser, whereby a stable connector can be formed at a low cost wherein the inserted cable will not fall out as well as rotation.

BRIEF DESCRIPTION OF THE DRAWINGS

FIG. 3(*a*) is a front view and FIG. 3(*b*) is a cross sectional view taken on the line B-B.

FIG. 12(*a*) is a front view and FIG. 12(*b*) is a cross sectional view taken on the line D-D.

FIG. 13(*a*) is a front view and FIG. 13(*b*) is a cross sectional view taken on the line E-E.

EXPLANATION OF REFERENCE NUMBERS

Figure 1:
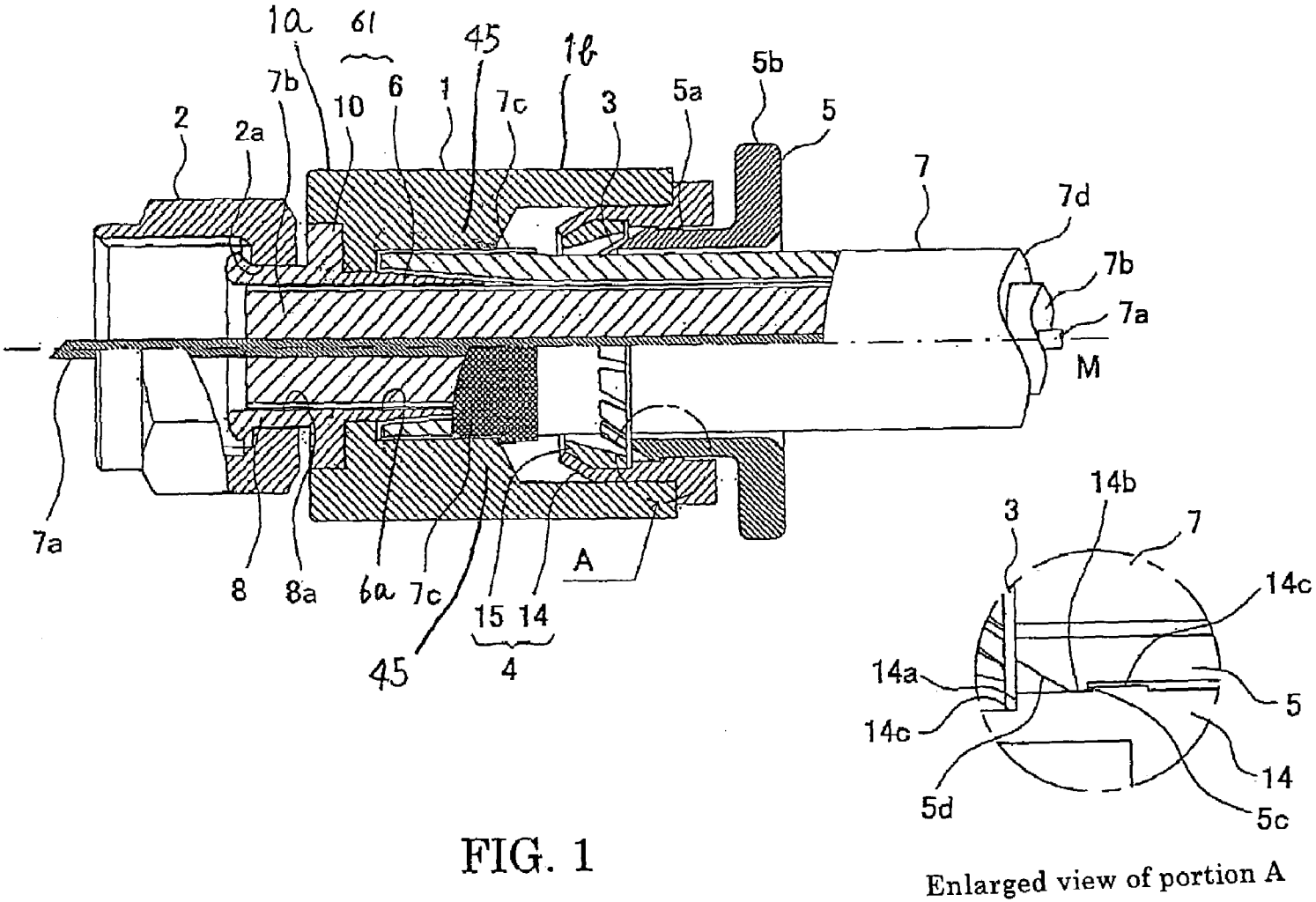
FIG. 1 shows a first embodiment of a coaxial cable connector according to the present invention, and it is a side lateral view showing the coaxial cable connector in partial cross section when inserting a coaxial cable into the connector and an enlarged view of portion A.
Figure 2:
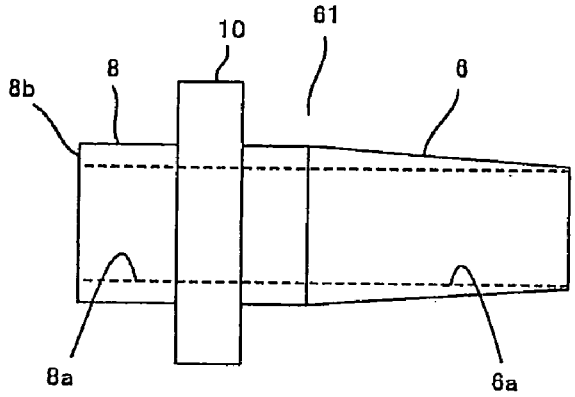
FIG. 2 is a perspective view of the sleeve of FIG. 1.
Figure 2:
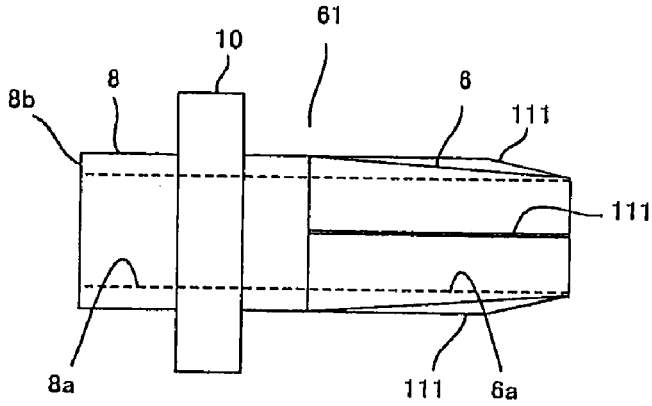
Figure 2:
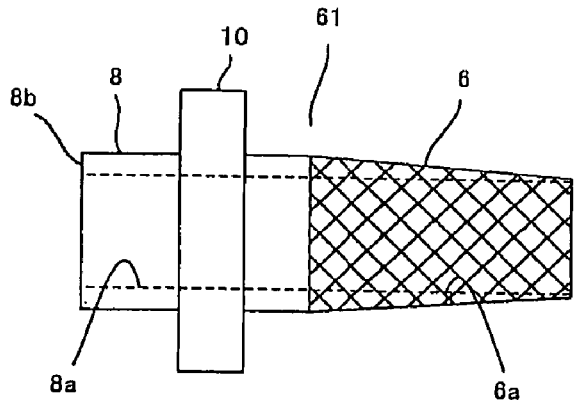
Figure 3:
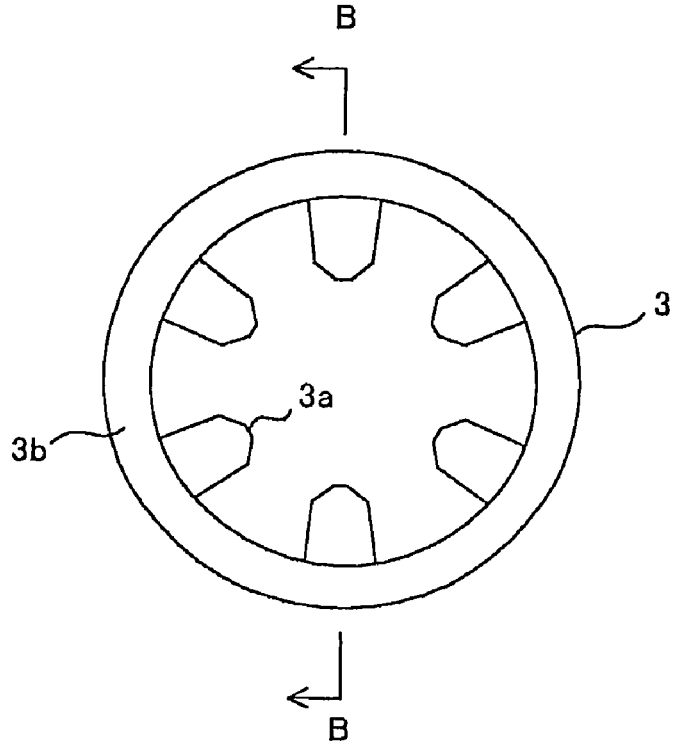
FIG. 3 shows the stopper of FIG. 1.
Figure 3:
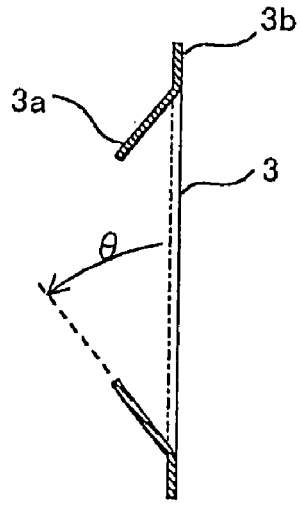
Figure 4:
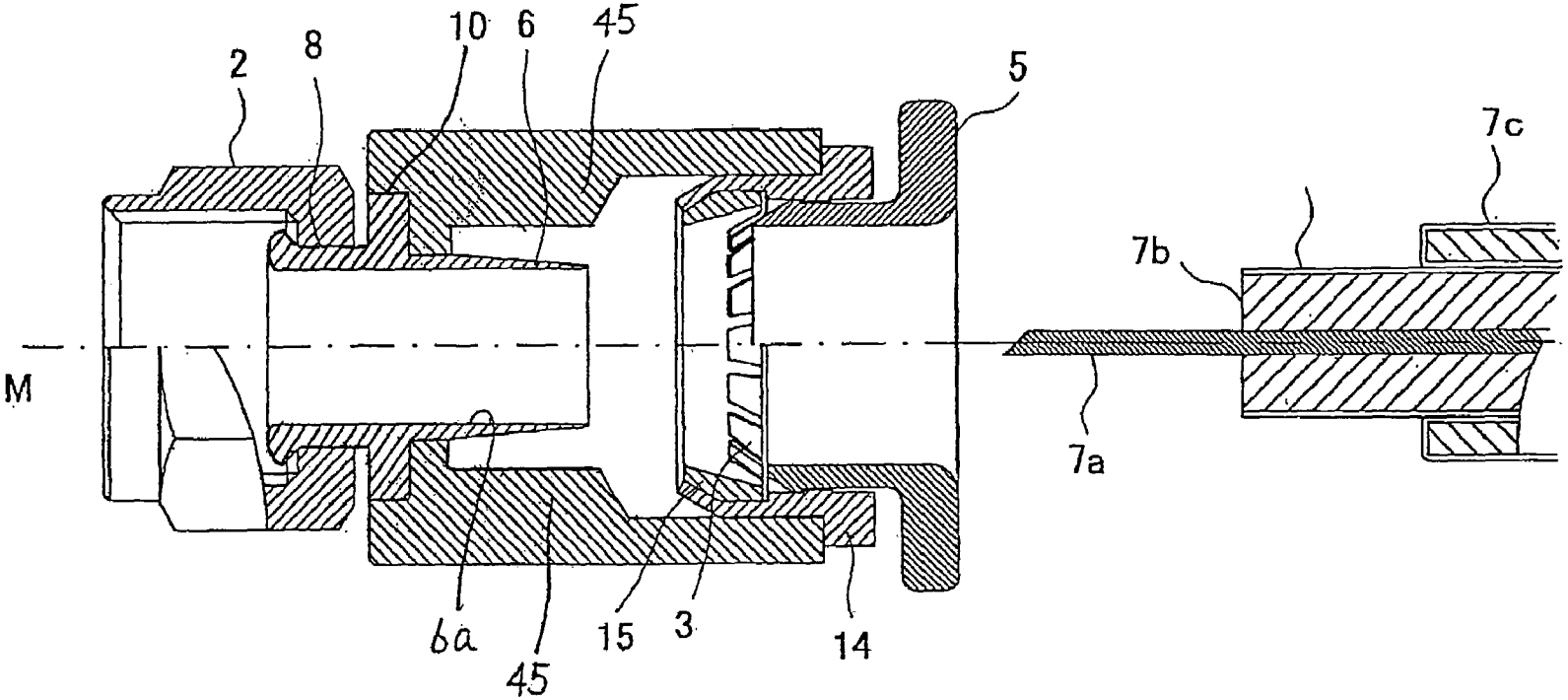
FIG. 4 is a side lateral view of the coaxial cable connector of FIG. 1 before a coaxial cable is inserted into the connector.
Figure 5:
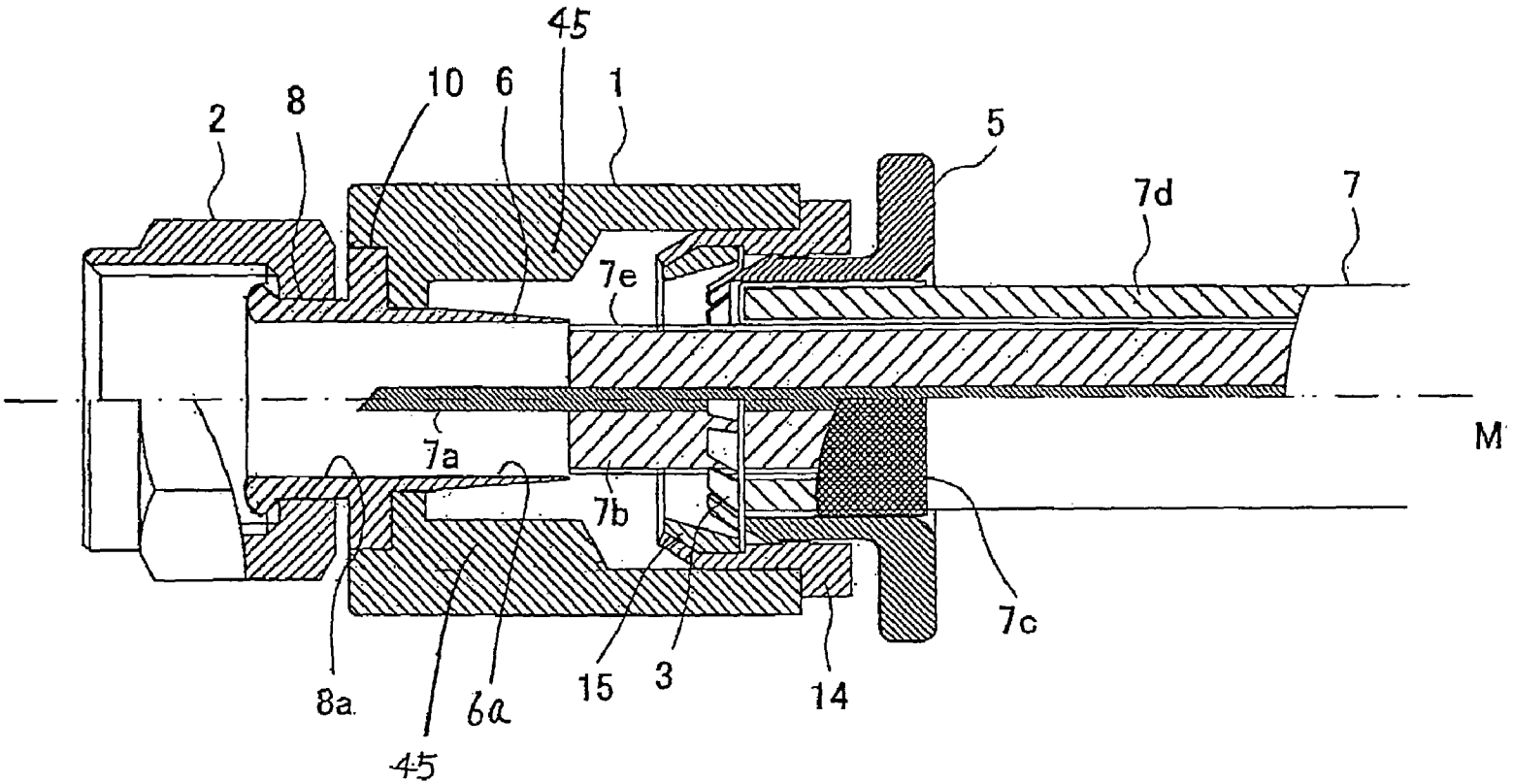
FIG. 5 is a side lateral view of the coaxial cable connector of FIG. 1 showing a way of inserting a coaxial cable into the connector.
Figure 6:
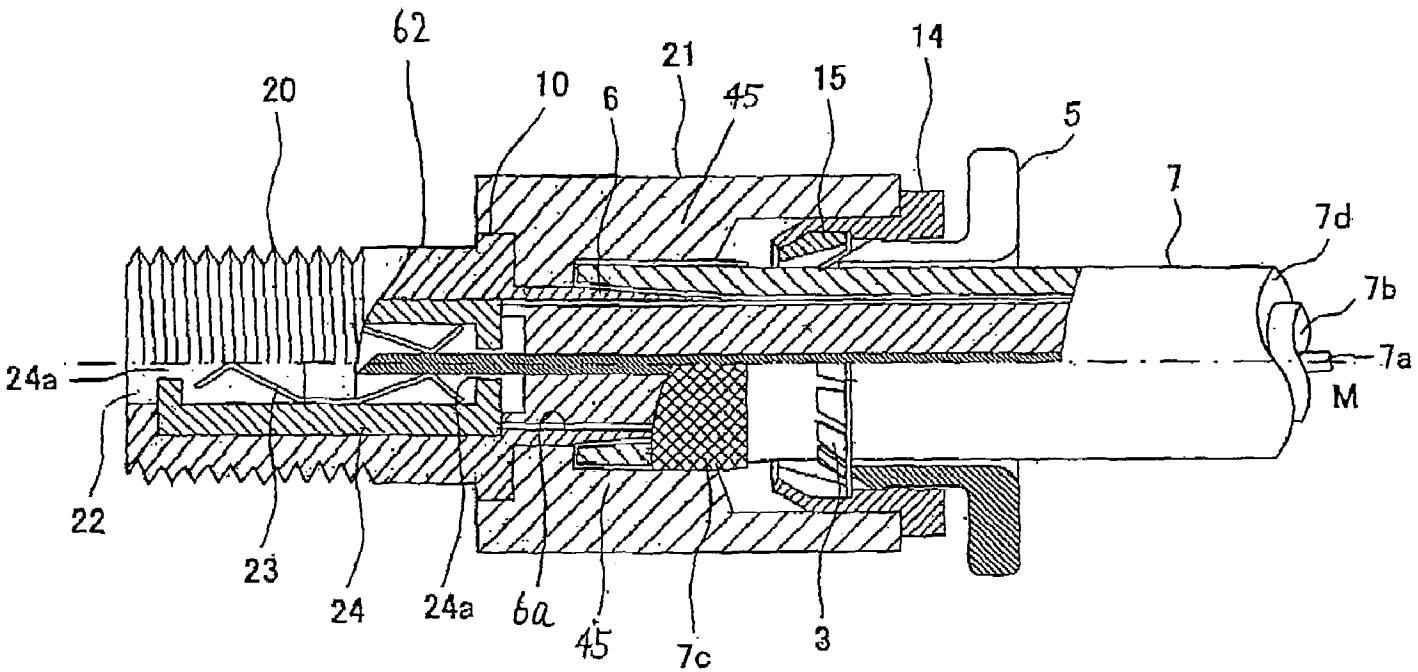
FIG. 6, which shows a second embodiment of a coaxial cable connector according to the present invention, is a side lateral view showing a partial cross section.
Figure 7:
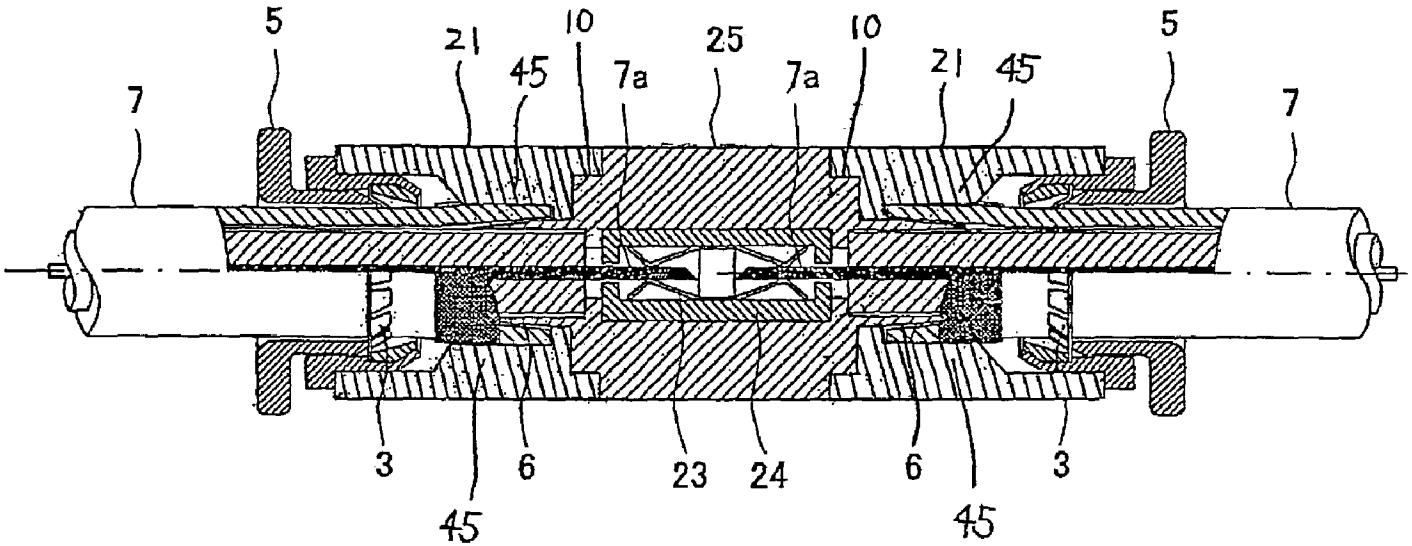
FIG. 7 shows another embodiment of a coaxial cable connector according to the present invention and it is a side lateral view showing a partial cross section.
Figure 8:
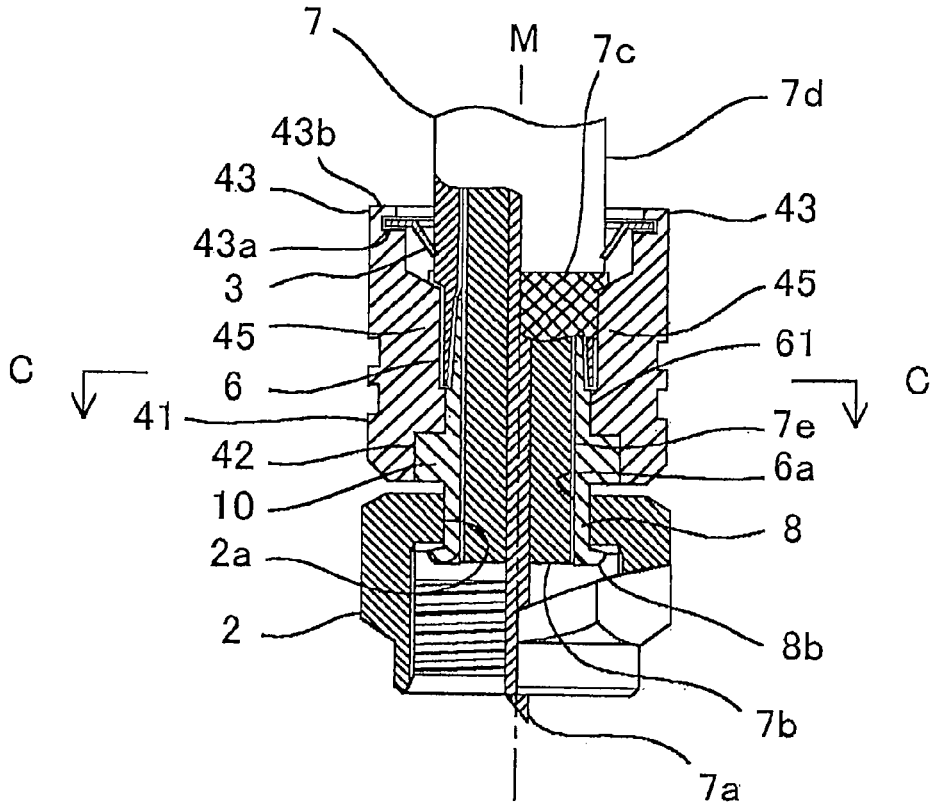
FIG. 8 shows a third embodiment of a coaxial cable connector according to the present invention, and it is a cross sectional view when a coaxial cable is inserted into the connector.
Figure 8:
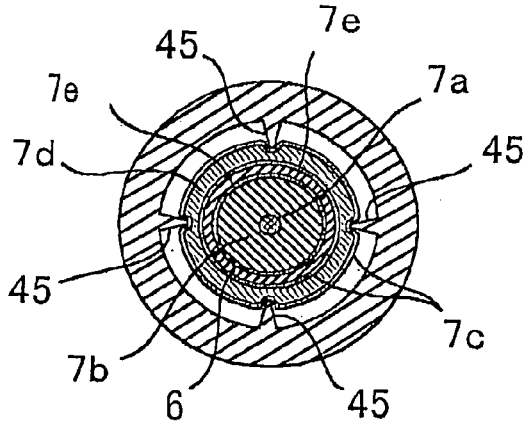
Figure 9:
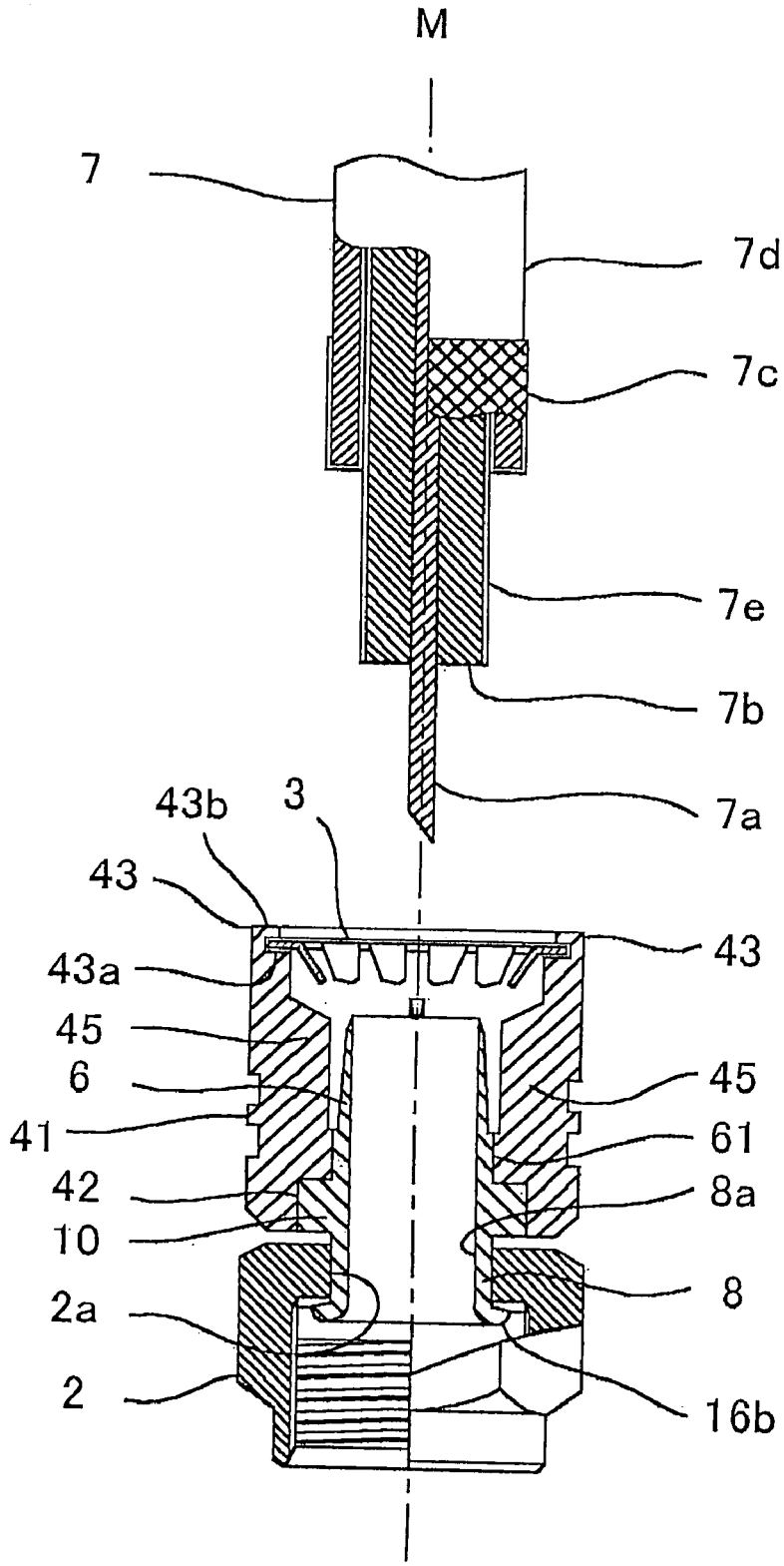
FIG. 9 shows a state before inserting the coaxial cable into the connector of FIG. 8.
Figure 10:
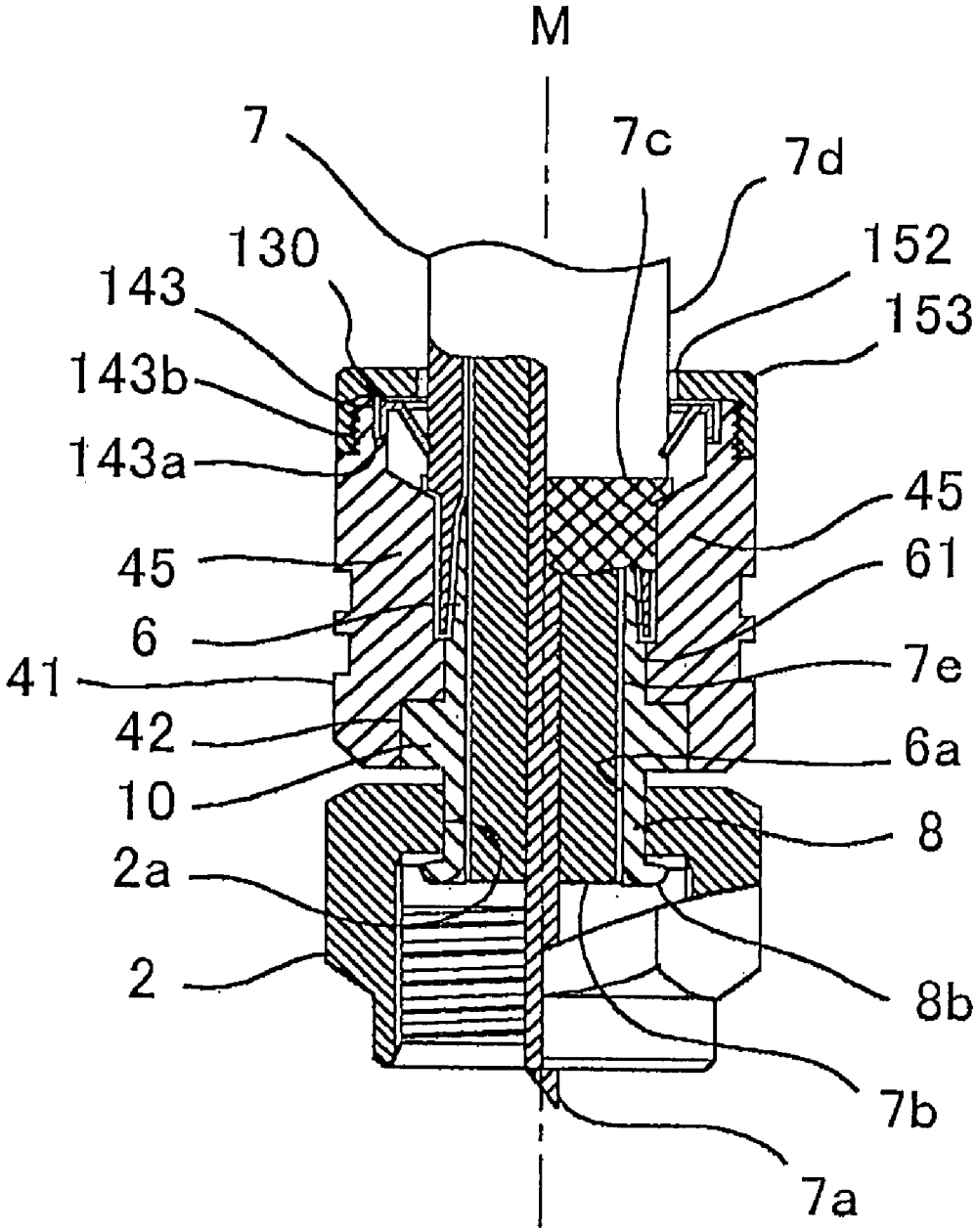
FIG. 10 shows a fourth embodiment of a coaxial cable connector according to the present invention, and it is a cross sectional view when a coaxial cable is inserted into the connector.
Figure 11:
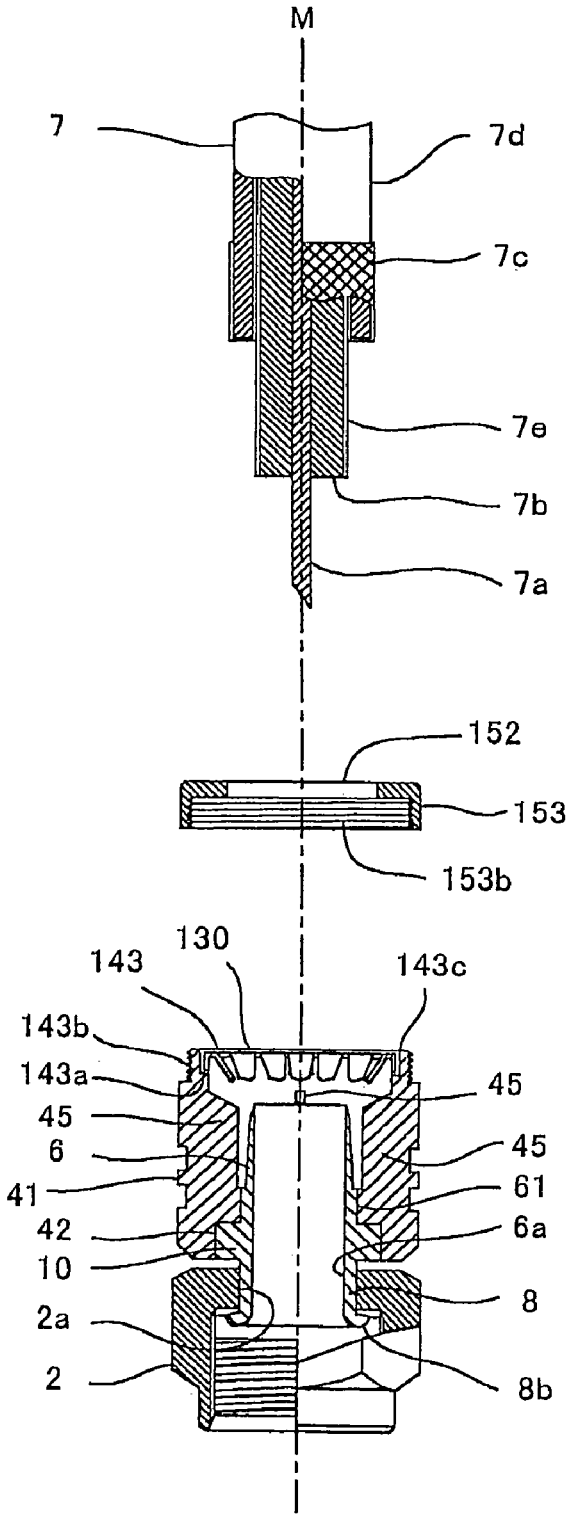
FIG. 11 shows a state before the coaxial cable is inserted into the connector of FIG. 10.
Figure 12:
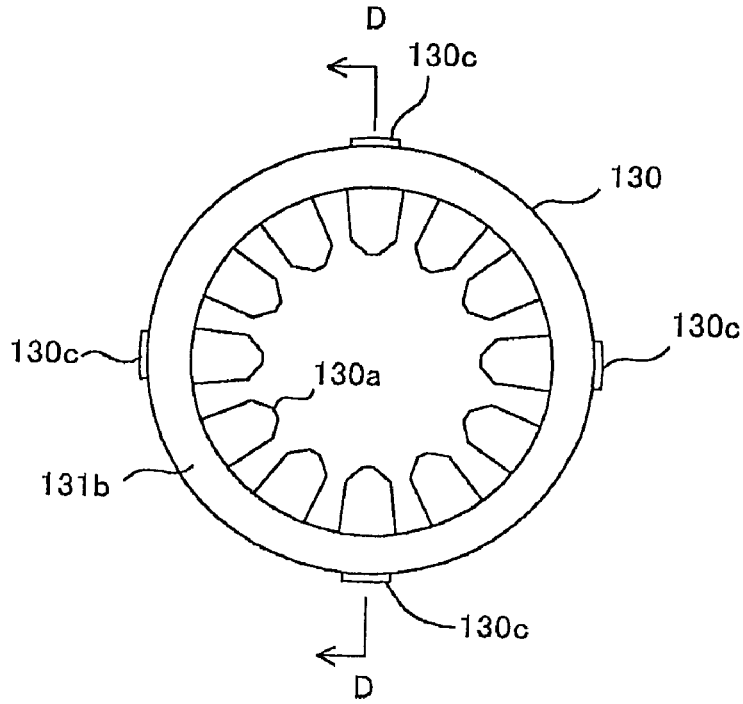
FIG. 12 shows a stopper of FIG. 10.
Figure 12:
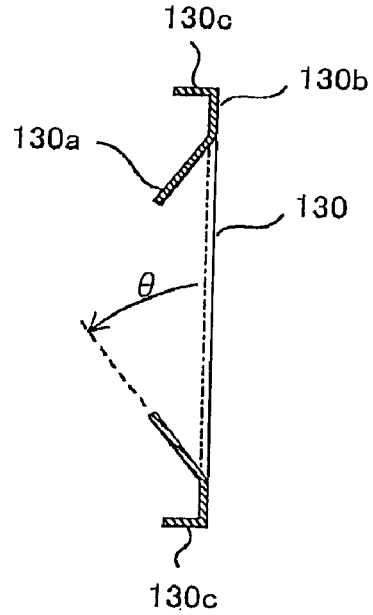
Figure 13:
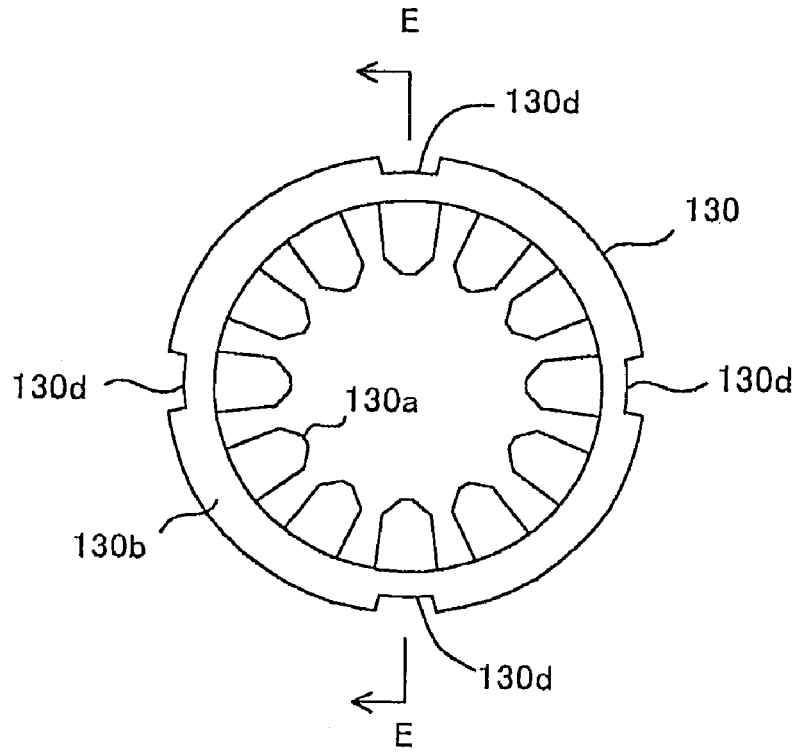
FIG. 13 shows another embodiment of the stopper of FIG. 10.
Figure 13:
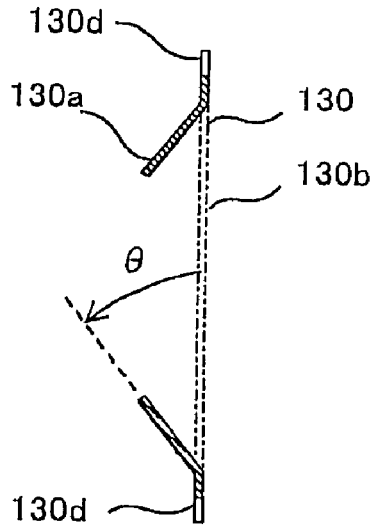
Figure 14:
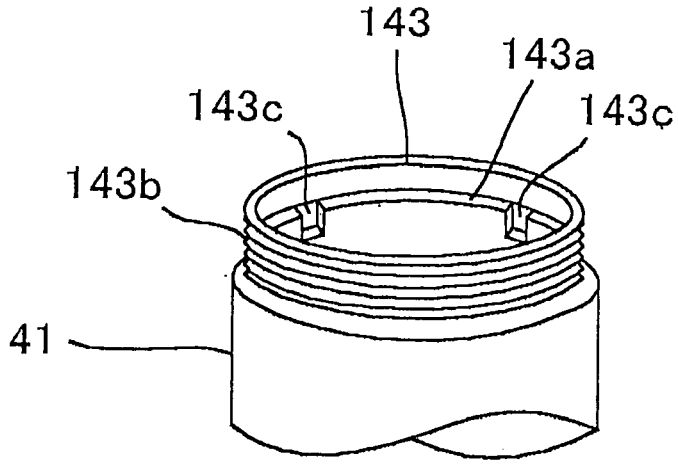
FIG. 14(*a*) shows a partially enlarged perspective view of a through hole for a cable according to the stopper of FIG. 12 and FIG. 14(*b*) shows a partially enlarged perspective view of a through hole for a cable according to the stopper of FIG. 13.
Figure 14:
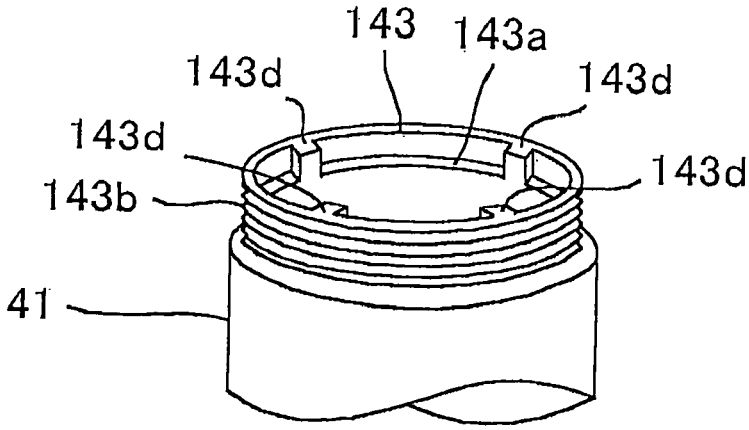
Figure 15:
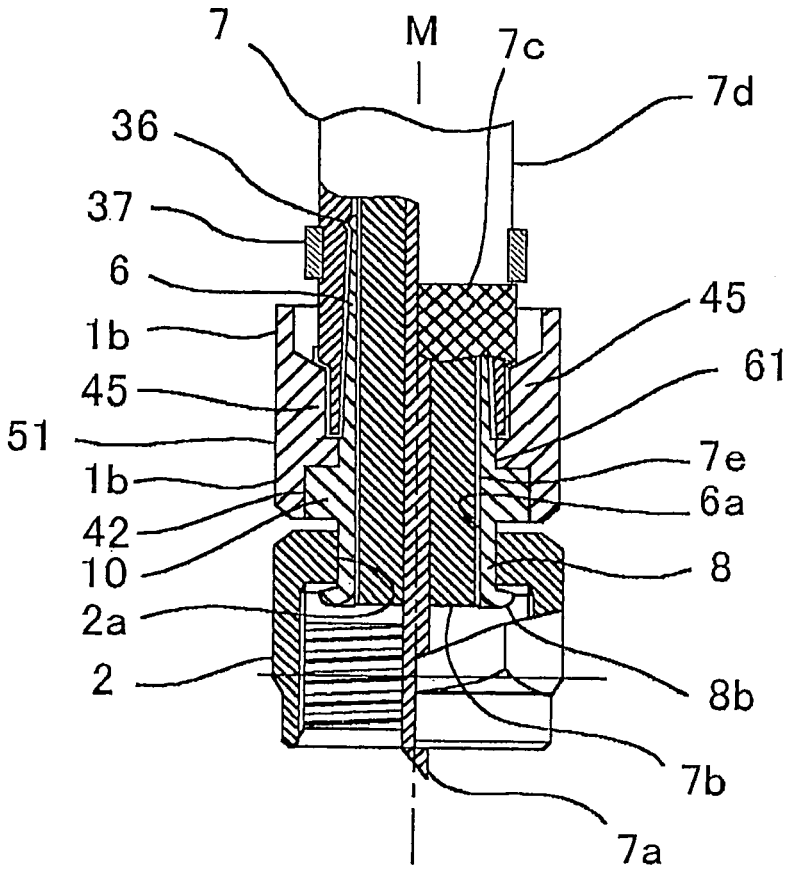
FIG. 15 shows a fifth embodiment of a coaxial cable connector according to the present invention, and it is a cross sectional view when a coaxial cable is inserted into the connector.
Figure 15:
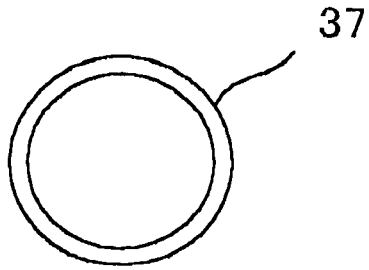
Figure 16:
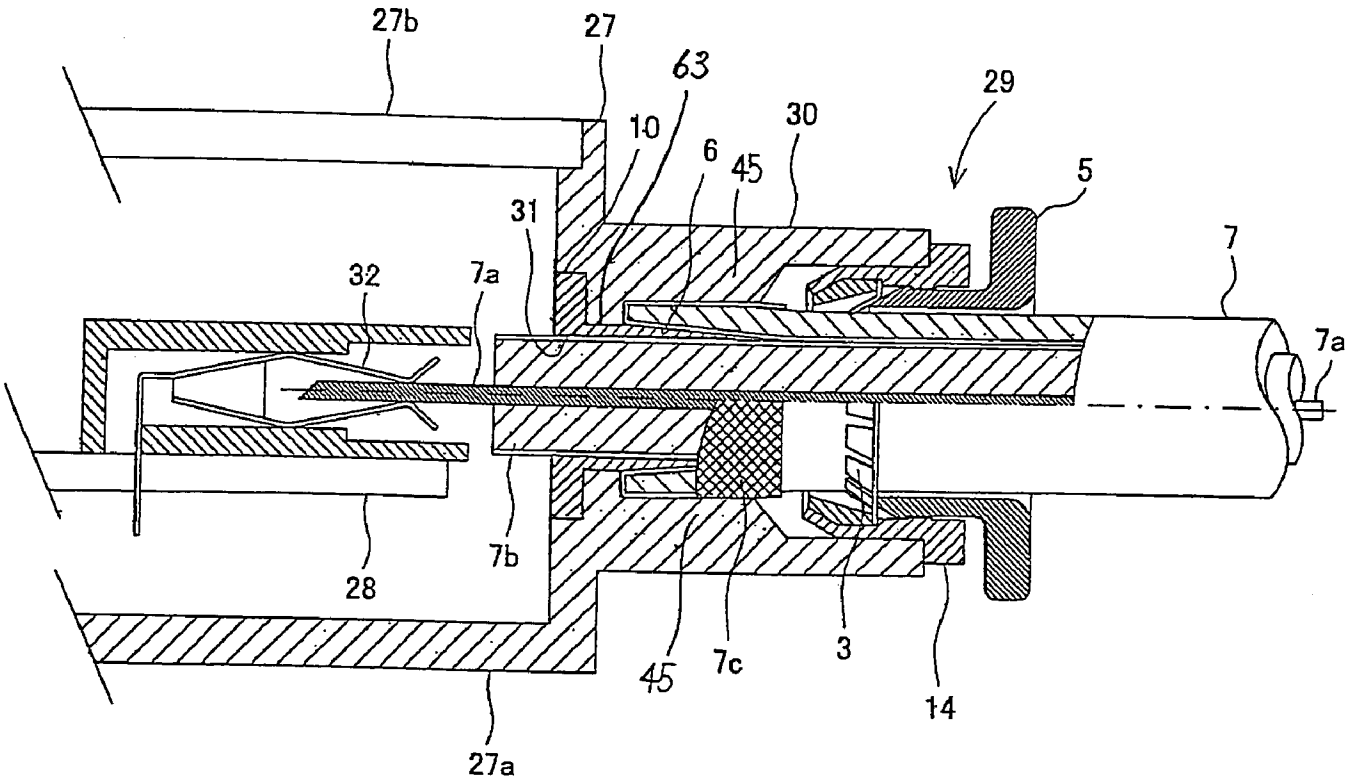
FIG. 16 is an explanatory cross sectional view showing one example of a case for an electronic device according to the present invention.

| | |
|---|---|
| 1. | main body of a connector |
| 1a. | attaching portion |
| 1b. | cylindrical portion |
| 2. | nut (connecting means) |
| 3. | stopper |
| 3a. | claw |
| 3b. | fastening portion |
| 4. | anchor |
| 5. | releaser |
| 6. | inserting portion |
| 7. | coaxial cable |
| 8. | cylindrical fitting portion |
| 10. | ring-shaped joining portion |
| 20. | bolt (connecting means) |
| 21. | main body of a connector |
| 25. | connector cylinder |
| 27. | case |
| 29. | connector |
| 30. | main body of a connector |
| 35. | knurl (processing for blocking the coaxial cable) |
| 36. | ring-shaped projection (processing for blocking the coaxial cable) |
| 37. | crimping ring |
| 41. | main body of a connector |
| 42. | fitting hole |
| 43. | cable inserting hole |
| 45. | strip-shaped projection (rotation-stopping means) |
| 51. | main body of a connector |
| 61, 62, 63. | sleeve |
| 111. | strip-shaped projection (processing for the blocking function) |
| 130. | stopper |
| 153. | fixing cap |

The invention claimed is:

1. A coaxial cable connector comprising:

a sleeve having an inserting portion to be inserted into between an inner insulator and an outer conductor of the coaxial cable;

a cylindrical main body provided at the periphery of the inserting portion; connecting means provided rotatably in front of the sleeve for being connected with the outer conductor of a connecting object, and a stopper provided in the main body for supporting the circumference of the coaxial cable in order to prevent the fall-out of the coaxial cable, wherein the stopper is constituted by a ring-shaped fastening portion that is internally provided in the main body so that its central axis is the same as that of the main body, and a supporting portion that is protruded from the fastening portion towards the central axis of the main body, wherein rotation-stopping means is provided on at least an inner surface of the main body, the rotation-stopping means is constituted by a strip-shaped projection which is longitudinally formed so as to bite into the circumference of the inserted coaxial cable, wherein when an end of the coaxial cable is inserted into the main body of the connector from backward, the stopper prevents the fall-out of the coaxial cable because the supporting portion supports the circumference of the coaxial cable, and the strip-shaped projection prevents rotation of the coaxial cable.

2. The coaxial cable connector according to claim 1, wherein said supporting portion of said stopper is formed such that said distal end thereof is coaxially aligned and in contact with the inserted coaxial cable.

3. The coaxial cable connector according to claim 1, further comprising: a releaser for releasing the locking force of said stopper that is exerted on the inserted coaxial cable, said releaser including a cylindrical sliding portion for covering the coaxial cable and an operating portion for operating the sliding portion, wherein a distal end of said sliding portion of said releaser abuts the supporting portion of said stopper and pushes said supporting portion up by sliding the sliding portion forward to release the inserted coaxial cable.

4. The coaxial cable connector according to claim 1, further comprising fastening means for fastening the stopper in the main body and preventing the axial movement with respect to the main body and rotation around the axis.

5. The coaxial cable connector according to claim 1, wherein said connecting means comprises a nut female-screwed on an inner surface, and a cylindrical fitting portion on which said nut is fit which protrudes in front of said sleeve in order to support a rear portion of the nut in a rotatable manner;

wherein a through hole is provided in said cylindrical fitting portion through which the inner insulator and a central conductor of the inserted coaxial cable penetrate in series with a through hole of said sleeve; and wherein the central conductor of the inserted coaxial cable protrudes from a through hole arranged on the central axis of said nut.

6. A coaxial cable connector comprising:

a cylindrical main body into which a coaxial cable is inserted, and connecting means provided in a front portion of said main body to connect said main body with a connecting object, wherein said main body includes a sleeve penetrating between an inner insulator and an outer conductor of the inserted coaxial cable and a stopper for preventing the inserted coaxial cable from falling out;

wherein said stopper is formed in a substantially conical shape, wherein an inner diameter of said stopper is smaller than an outer diameter of the inserted cable, wherein an inner peripheral portion of a distal end of said stopper comprises a supporting portion for supporting the circumference of the coaxial cable, and an outer peripheral portion of said distal end of said stopper comprises a fastening portion to fasten said stopper within said main body of said connector, and wherein at least said supporting portion of said stopper has an elastic property in a diameter direction of said stopper;

wherein said supporting portion supports the coaxial cable and prevents the coaxial cable from falling out when an end of the coaxial cable is inserted into the main body of the connector from a rear portion of said connector, wherein the coaxial cable connector includes rotation-stopping means to prevent rotation of the inserted coaxial cable, said rotation-stopping means being provided perpendicular to a rotation direction of the inserted coaxial cable, wherein said rotation-stopping means comprises a strip-shaped projection longitudinally formed along a side surface of said sleeve.

7. A coaxial cable connector comprising:

a cylindrical main body into which a coaxial cable is inserted, said main body including a sleeve penetrating between an inner insulator and an outer conductor of the inserted coaxial cable, and a stopper for preventing the inserted coaxial cable from falling out;

connecting means provided in a front portion of said main body to connect said main body with a connecting object; and rotation-stopping means to prevent rotation of the inserted coaxial cable, said rotation-stopping means comprising a strip-shaped projection longitudinally formed along the side surface of said sleeve;

wherein said stopper is formed in a substantially conical shape, wherein an inner peripheral portion of a distal end of said stopper comprises a supporting portion for supporting the circumference of the coaxial cable, and an outer peripheral portion of said distal end of said stopper comprises a fastening portion to fasten said stopper within said main body of said connector, and wherein at least said supporting portion of said stopper has an elastic property in a diameter direction of said stopper; and wherein said supporting portion supports the circumference of the coaxial cable and prevents the coaxial cable from falling out when an end of the coaxial cable is inserted into the main body of the connector from a rear portion of said connector.

* * * * *

UNITED STATES PATENT AND TRADEMARK OFFICE

CERTIFICATE OF CORRECTION

PATENT NO. : 7,261,594 B2
APPLICATION NO. : 11/413622
DATED : August 28, 2007
INVENTOR(S) : Wataru Kodama et al.

It is certified that error appears in the above-identified patent and that said Letters Patent is hereby corrected as shown below:

Title Page

*Please add to Item (30) Foreign Application Priority Data*

June 20, 2003 (JP) ..... 2003-177146
Nov. 5, 2003 (JP) ..... 2003-376204
May 21, 2004 (JP) ..... 2004-152371

*Please add:*

Item (65) Related U.S. Application Data

This application is a continuation in part of 10/867,122 filed on June 14, 2004.

Signed and Sealed this

Eighteenth Day of December, 2007

JON W. DUDAS
*Director of the United States Patent and Trademark Office*